US011200854B2

(12) United States Patent
Wang

(10) Patent No.: US 11,200,854 B2
(45) Date of Patent: Dec. 14, 2021

(54) DISPLAY CONTROL METHOD, APPARATUS, AND DISPLAY PANEL

(71) Applicant: BOE Technology Group Co., Ltd., Beijing (CN)

(72) Inventor: Yu Wang, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 15 days.

(21) Appl. No.: 16/763,970

(22) PCT Filed: Dec. 18, 2019

(86) PCT No.: PCT/CN2019/126210

§ 371 (c)(1),
(2) Date: May 13, 2020

(87) PCT Pub. No.: WO2020/140754

PCT Pub. Date: Jul. 9, 2020

(65) Prior Publication Data

US 2021/0319758 A1 Oct. 14, 2021

(30) Foreign Application Priority Data

Jan. 4, 2019 (CN) ..... 201910007572.5

(51) Int. Cl.
*G09G 3/3233* (2016.01)
*G09G 3/3291* (2016.01)

(52) U.S. Cl.
CPC ..... *G09G 3/3291* (2013.01); *G09G 2320/041* (2013.01)

(58) Field of Classification Search
CPC .. G09G 3/3225; G09G 3/3233; G09G 3/3258; G09G 3/3283; G09G 3/3291;
(Continued)

(56) References Cited

U.S. PATENT DOCUMENTS

2009/0256854 A1 10/2009 Mizukoshi et al.
2013/0050292 A1* 2/2013 Mizukoshi ..... G09G 3/3291 345/690

(Continued)

FOREIGN PATENT DOCUMENTS

CN 102968954 A 3/2013
CN 103489405 A 1/2014

(Continued)

OTHER PUBLICATIONS

Office Action dated Apr. 1, 2020 for Chinese Patent Application No. 201910007572.5 and English Translation.

(Continued)

*Primary Examiner* — Michael J Eurice
(74) *Attorney, Agent, or Firm* — Ling Wu; Stephen Yang; Ling and Yang Intellectual Property

(57) ABSTRACT

The present disclosure proposes a display control method, an apparatus and a display panel. The display control method comprises: in response to turning on a display panel, acquiring a current first sensing voltage when a data voltage is equal to a first set data voltage; and compensating display data based on the current first sensing voltage. The display control method, apparatus and display panel according to the present disclosure may accurately compensate the display data of the display panel and improve the display effect.

18 Claims, 6 Drawing Sheets

(58) Field of Classification Search
CPC ..... G09G 2300/043; G09G 2300/0819; G09G 2320/0204; G09G 2320/0233; G09G 2320/0285; G09G 2320/0295; G09G 2320/041; G09G 2320/043; G09G 2320/045; G09G 2320/0693
See application file for complete search history.

(56) References Cited

U.S. PATENT DOCUMENTS

| | | | | |
|---|---|---|---|---|
| 2015/0154908 | A1* | 6/2015 | Nam | G09G 3/3233 345/76 |
| 2015/0179102 | A1* | 6/2015 | Kim | G09G 3/3291 345/77 |
| 2015/0179107 | A1* | 6/2015 | Kim | G09G 3/3233 345/212 |
| 2015/0325170 | A1* | 11/2015 | Jeon | G09G 3/006 345/1.2 |
| 2016/0086539 | A1 | 3/2016 | Mizukoshi | |
| 2017/0193909 | A1* | 7/2017 | Song | G09G 3/2074 |
| 2018/0182303 | A1* | 6/2018 | Jung | G09G 3/3233 |
| 2020/0035154 | A1* | 1/2020 | Zeng | G09G 3/3233 |

FOREIGN PATENT DOCUMENTS

| | | | |
|---|---|---|---|
| CN | 104700772 | A | 6/2015 |
| CN | 104732916 | A | 6/2015 |
| CN | 104732918 | A | 6/2015 |
| CN | 105096834 | A | 11/2015 |
| CN | 107610648 | A | 1/2018 |
| CN | 109616053 | A | 4/2019 |
| KR | 20180078995 | A | 7/2018 |

OTHER PUBLICATIONS

International Search Report for PCT/CN2019/126210 dated Mar. 2, 2020.

* cited by examiner

DISPLAY CONTROL METHOD, APPARATUS, AND DISPLAY PANEL

CROSS-REFERENCE TO RELATED APPLICATIONS

The present disclosure is a U.S. National Phase Entry of International PCT Application No. PCT/CN2019/126210 having an international filing date of Dec. 18, 2019, which claims a priority to Chinese Patent Application No. 201910007572.5, entitled "Display Control Method, Apparatus, and Display Panel" filed on Jan. 4, 2019 by BOE Technology Group Co., Ltd. The above-identified applications are incorporated by reference herein in their entirety.

FIELD

The present disclosure relates to the field of electrical technologies, and more particularly, to a display control method, an apparatus, and a display panel.

BACKGROUND

With the advancement of time, active-matrix organic light-emitting diode (AMOLED) display panels, characterized by high contrast, high color gamut, light and thin quality, and flexible screens, are more and more widely used, and increasingly received by people.

After the AMOLED display panel is lit, the temperature of the panel will change, and characteristics of the thin film transistor (TFT) in the panel will also change with the temperature of the panel (for example, the threshold voltage and mobility of the TFT drift with the temperature), which result in poor display effect of the AMOLED display panel.

SUMMARY

The present disclosure aims to solve one of the technical problems in the related art at least to a certain extent.

To this end, the first objective of the present disclosure is to provide a display control method. In response to turning on a display panel, a current first sensing voltage is acquired when a data voltage is equal to a first set data voltage, and display data is compensated based on the current first sensing voltage, which may accurately compensate the display data of the display panel and improve the display effect.

A second objective of the present disclosure is to provide a display control apparatus.

A third objective of the present disclosure is to provide a display panel.

A fourth objective of the present disclosure is to provide an electronic device.

A fifth objective of the present disclosure is to provide a non-transitory computer-readable storage medium.

To achieve the above objectives, embodiments of a first aspect of the present disclosure provide a display control method, including: in response to turning on a display panel, acquiring a current first sensing voltage when a data voltage is equal to a first set data voltage; and compensating display data based on the current first sensing voltage.

With the display control method according to the embodiments of the present disclosure, in response to turning on the display panel, the current first sensing voltage is acquired when the data voltage is equal to the first set data voltage, and then the display data is compensated based on the current first sensing voltage, which may accurately compensate the display data of the display panel and improve the display effect.

According to an embodiment of the present disclosure, compensating the display data based on the current first sensing voltage includes: acquiring, based on the current first sensing voltage, a variation of a current threshold voltage and a variation of a current compensation coefficient of a thin film transistor (TFT) corresponding to the current first sensing voltage; and compensating the display data based on the variation of the current threshold voltage and the variation of the current compensation coefficient.

According to an embodiment of the present disclosure, compensating the display data based on the variation of the current threshold voltage and the variation of the current compensation coefficient includes: compensating the display data through a preset formula, in which the preset formula is denoted by: $data1=\Delta K'*K0*data+\Delta Vth'+Vth0$, where data1 represents the display data after compensation; $\Delta K'$ represents the variation of the current compensation coefficient; K0 represents an initial value of a compensation coefficient of the display panel at normal temperature; data represents the display data before compensation; $\Delta Vth'$ represents the variation of the current threshold voltage; and Vth0 represents an initial value of a threshold voltage of the display panel at normal temperature.

According to an embodiment of the present disclosure, acquiring, based on the current first sensing voltage, the variation of the current threshold voltage and the variation of the current compensation coefficient of the thin film transistor (TFT) corresponding to the current first sensing voltage includes: acquiring a variation of a threshold voltage corresponding to the current first sensing voltage based on the current first sensing voltage and a pre-stored correspondence relation curve between a first sensing voltage and the variation of the threshold voltage; determining the variation of the threshold voltage corresponding to the current first sensing voltage as the variation of the current threshold voltage; acquiring a variation of a compensation coefficient corresponding to the current first sensing voltage based on the current first sensing voltage and a pre-stored correspondence relation curve between the first sensing voltage and the variation of the compensation coefficient; and determining the variation of the compensation coefficient corresponding to the current first sensing voltage as the variation of the current compensation coefficient.

According to an embodiment of the present disclosure, the display control method further includes: generating the correspondence relation curve between the first sensing voltage and the variation of the threshold voltage based on a variation curve of the variation of the threshold voltage versus temperature and a variation curve of the first sensing voltage versus temperature.

According to an embodiment of the present disclosure, the display control method further includes: in response to turning off the display panel, acquiring a second sensing voltage at different temperatures in response to the data voltage being equal to a second set data voltage; calculating a difference between the second set data voltage and the second sensing voltage to obtain the threshold voltage; generating a variation curve of the threshold voltage versus temperature based on the threshold voltage at different temperatures; and generating the variation curve of the variation of the threshold voltage versus temperature based on the variation curve of the threshold voltage versus temperature.

According to an embodiment of the present disclosure, the display control method further includes: generating the correspondence relation curve between the first sensing voltage and the variation of the compensation coefficient based on a variation curve of the variation of the compensation coefficient versus temperature and the variation curve of the first sensing voltage versus temperature.

According to an embodiment of the present disclosure, the display control method further includes: in response to turning off the display panel, acquiring a third sensing voltage at different temperatures in response to the data voltage being equal to a third set data voltage, in which the third set data voltage is equal to a sum of the second set voltage and the threshold voltage at a corresponding temperature; calculating a ratio of a preset sensing voltage threshold to the third sensing voltage to obtain the compensation coefficient; generating a variation curve of the compensation coefficient versus temperature based on the compensation coefficient at different temperatures; and generating the variation curve of the variation of the compensation coefficient versus temperature based on the variation curve of the compensation coefficient versus temperature.

To achieve the above objectives, embodiments of the second aspect of the present disclosure provide a display control apparatus, including: a first acquisition module, configured to, in response to turning on a display panel, acquire a current first sensing voltage when a data voltage is equal to a first set data voltage; and a compensation module, configured to compensate display data based on the current first sensing voltage.

With the display control apparatus according to the embodiments of the present disclosure, in response to turning on the display panel, the current first sensing voltage is acquired when the data voltage is equal to the first set data voltage, and then the display data is compensated based on the current first sensing voltage, which may accurately compensate the display data of the display panel and improve the display effect.

According to an embodiment of the present disclosure, the compensation module is configured to: acquire, based on the current first sensing voltage, a variation of a current threshold voltage and a variation of a current compensation coefficient of a thin film transistor (TFT) corresponding to the current first sensing voltage; and compensate the display data based on the variation of the current threshold voltage and the variation of the current compensation coefficient.

According to an embodiment of the present disclosure, the compensation module is configured to: compensate the display data through a preset formula, in which the preset formula is denoted by: $data1=\Delta K'*K0*data+\Delta Vth'+Vth0$, where data1 represents the display data after compensation; $\Delta K'$ represents the variation of the current compensation coefficient; K0 represents an initial value of a compensation coefficient of the display panel at normal temperature; data represents the display data before compensation; $\Delta Vth'$ represents the variation of the current threshold voltage; and Vth0 represents an initial value of a threshold voltage of the display panel at normal temperature.

According to an embodiment of the present disclosure, the compensation module is configured to: acquire a variation of a threshold voltage corresponding to the current first sensing voltage based on the current first sensing voltage and a pre-stored correspondence relation curve between a first sensing voltage and the variation of the threshold voltage; determine the variation of the threshold voltage corresponding to the current first sensing voltage as the variation of the current threshold voltage; acquire a variation of a compensation coefficient corresponding to the current first sensing voltage based on the current first sensing voltage and a pre-stored correspondence relation curve between the first sensing voltage and the variation of the compensation coefficient; and determine the variation of the compensation coefficient corresponding to the current first sensing voltage as the variation of the current compensation coefficient.

According to an embodiment of the present disclosure, the display control apparatus further includes a first generation module. The first generation module is configured to generate the correspondence relation curve between the first sensing voltage and the variation of the threshold voltage based on a variation curve of the variation of the threshold voltage versus temperature and a variation curve of the first sensing voltage versus temperature.

According to an embodiment of the present disclosure, the display control apparatus further includes: a second acquisition module, configured to, in response to turning off the display panel, acquire a second sensing voltage at different temperatures in response to the data voltage being equal to a second set data voltage; a first calculation module, configured to calculate a difference between the second set data voltage and the second sensing voltage to obtain the threshold voltage; and a second generation module, configured to generate a variation curve of the threshold voltage versus temperature based on the threshold voltage at different temperatures, and to generate the variation curve of the variation of the threshold voltage versus temperature based on the variation curve of the threshold voltage versus temperature.

According to an embodiment of the present disclosure, the display control apparatus further includes a third generation module. The third generation module is configured to generate the correspondence relation curve between the first sensing voltage and the variation of the compensation coefficient based on a variation curve of the variation of the compensation coefficient versus temperature and the variation curve of the first sensing voltage versus temperature.

According to an embodiment of the present disclosure, the display control apparatus further includes: a third acquisition module, configured to, in response to turning off the display panel, acquire a third sensing voltage at different temperatures in response to the data voltage being equal to a third set data voltage, in which the third set data voltage is equal to a sum of the second set voltage and the threshold voltage at a corresponding temperature; a second calculation module, configured to calculate a ratio of a preset sensing voltage threshold to the third sensing voltage to obtain the compensation coefficient; a fourth generation module, configured to generate a variation curve of the compensation coefficient versus temperature based on the compensation coefficient at different temperatures, and to generate the variation curve of the variation of the compensation coefficient versus temperature based on the variation curve of the compensation coefficient versus temperature.

To achieve the above objectives, embodiments of a third aspect of the present disclosure provide a display panel including the display control apparatus according to the embodiments of the second aspect of the present disclosure.

According to an embodiment of the present disclosure, the display panel is an OLED display panel, or an AMOLED display panel.

To achieve the above objectives, embodiments of a fourth aspect of the present disclosure provide an electronic device. The electronic device includes a storage device, a processor, and a computer program stored on the storage device and executable on the processor. When the processor executes the program, the display control method according to the embodiments of the first aspect is implemented.

To achieve the above objectives, embodiments of a fifth aspect of the present disclosure provide a non-transitory computer-readable storage medium having a computer program stored thereon. When the program is executed by a processor, the display control method according to the embodiments of the first aspect is implemented.

DETAILED DESCRIPTION

Figure 1:
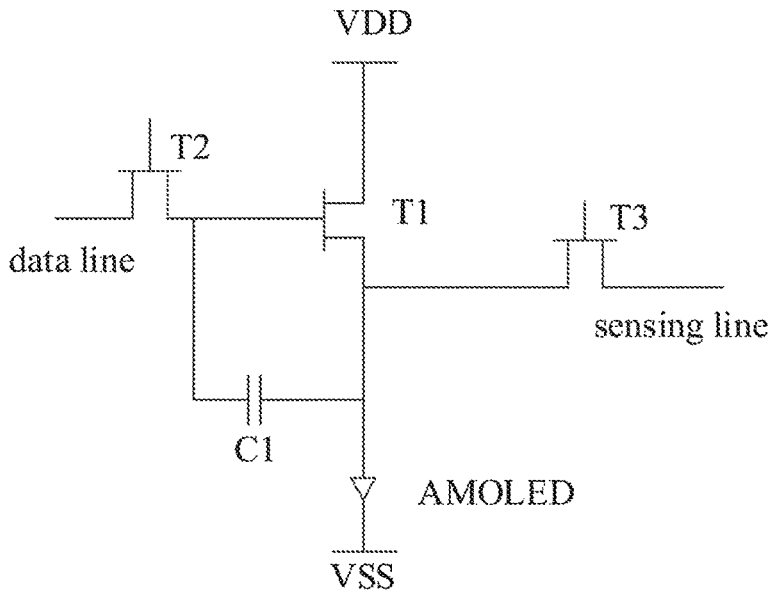
FIG. 1 is a compensation circuit diagram of an AMOLED display panel.

Descriptions will now be made in detail to embodiments, examples of which are illustrated in the accompanying drawings. The same or similar elements and the elements having same or similar functions are denoted by like reference numerals throughout the descriptions. The embodiments described herein with reference to the drawings are explanatory, illustrative, and used to generally understand the present disclosure. The embodiments shall not be construed to limit the present disclosure.

The display control method, apparatus, and display panel according to the embodiments of the present disclosure are described below with reference to the accompanying drawings.

FIG. 1 is a compensation circuit diagram of an AMOLED display panel. As illustrated in FIG. 1, the compensation circuit of the AMOLED display panel includes three TFTs, T1, T2, and T3, a storage capacitor C1, AMOLED, a data line, and a sensing line. VDD provides corresponding operating current for AMOLED. With the lighting of the AMOLED display panel, the temperature of the panel will change, and characteristics such as the threshold voltage and mobility of the TFT in the circuit will also change with the temperature of the panel, resulting in a poor display effect of the AMOLED display panel.

Figure 2:
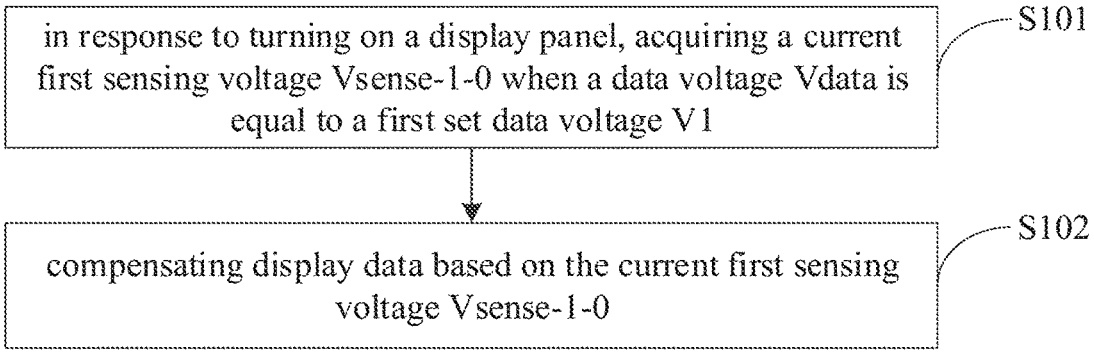
FIG. 2 is a flowchart of a display control method according to an embodiment of the present disclosure.

FIG. 2 is a flowchart of a display control method according to an embodiment of the present disclosure. As illustrated in FIG. 2, the display control method includes the following.

At block S101, in response to turning on a display panel, a current first sensing voltage Vsense-1-0 is acquired when a data voltage Vdata is equal to a first set data voltage V1.

In the embodiment of the present disclosure, the first set data voltage V1 may be preset. When the display panel is turned on, the data voltage Vdata of the data line is fixed to V1, that is, Vdata=V1. The current first sensing voltage Vsense-1-0 is acquired when Vdata=V1. In detail, Vsense-1-0 may be acquired through a sensing line illustrated in FIG. 1. The display panel may be an organic light-emitting diode (OLED) display panel or the AMOLED display panel.

At block S102, display data is compensated based on the current first sensing voltage Vsense-1-0.

In the embodiment of the present disclosure, the display data is compensated based on the first sensing voltage Vsense-1-0 acquired at block S101 to improve the display effect.

With the display control method according to the embodiments of the present disclosure, in response to turning on the display panel, the current first sensing voltage is acquired when the data voltage is equal to the first set data voltage, and then the display data is compensated based on the current first sensing voltage, which may accurately compensate the display data of the display panel and improve the display effect.

Figure 3:
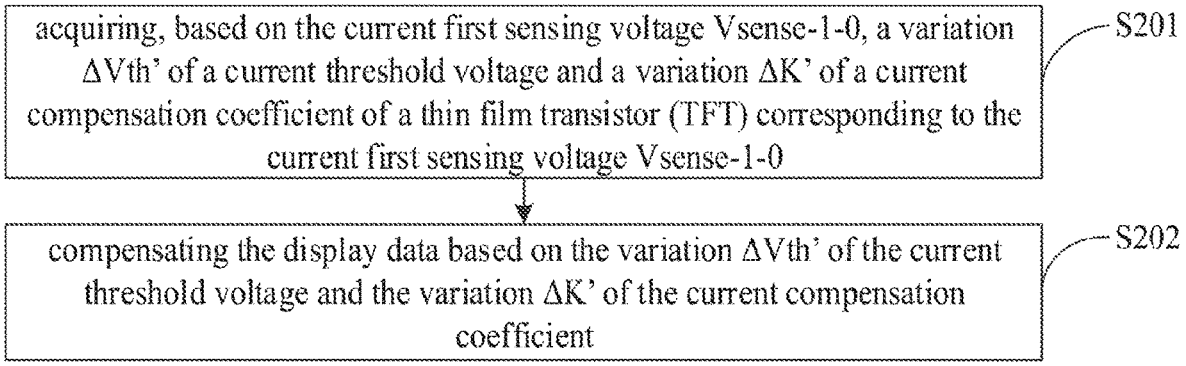
FIG. 3 is a flowchart of a display control method according to another embodiment of the present disclosure.

FIG. 3 is a flowchart of a display control method according to another embodiment of the present disclosure. The block S102 in the embodiment illustrated in FIG. 2 may specifically include the following.

At block S201, a variation ΔVth' of a current threshold voltage and a variation ΔK' of a current compensation coefficient of a thin film transistor (TFT) corresponding to the current first sensing voltage Vsense-1-0 are acquired based on the current first sensing voltage Vsense-1-0.

In the embodiment of the present disclosure, an initial value Vth0 of a threshold voltage at normal temperature and an initial value K0 of a compensation coefficient at normal temperature of the TFT corresponding to Vsense-1-0 may be acquired first. After acquiring the current first sensing voltage Vsense-1-0, the current threshold voltage Vth' and the current compensation coefficient K' of the TFT corresponding to Vsense-1-0 are acquired. Consequently, the variation ΔVth' of the current threshold voltage is expressed as ΔVth'=Vth'−Vth0, and the variation ΔK' of the current compensation coefficient is expressed as ΔK'=K'/K0, where the variation of the compensation coefficient may represent a variation of the electron mobility of the TFT in AMOLED. In detail, the compensation coefficient is inversely proportional to the electron mobility, and is affected by temperature, light, etc.

As a possible implementation, the acquisition method of ΔVth' may specifically be: acquiring a variation ΔVth of a threshold voltage corresponding to the current first sensing voltage Vsense-1-0 based on the current first sensing voltage Vsense-1-0 and a pre-stored correspondence relation curve between a first sensing voltage Vsense-1 and the variation ΔVth of the threshold voltage; and determining the variation ΔVth of the threshold voltage corresponding to the current first sensing voltage Vsense-1-0 as the variation ΔVth' of the current threshold voltage. In detail, the correspondence relation curve between the first sensing voltage Vsense-1 and the variation ΔVth of the threshold voltage is generated based on a variation curve of the variation ΔVth of the threshold voltage versus temperature and a variation curve of the first sensing voltage Vsense-1 versus temperature. The correspondence relation curve generated is stored. When Vsense-1-0 is acquired, the correspondence relation curve is queried to acquire ΔVth corresponding to Vsense-1-0, and then the ΔVth is determined as ΔVth'.

Figure 4:
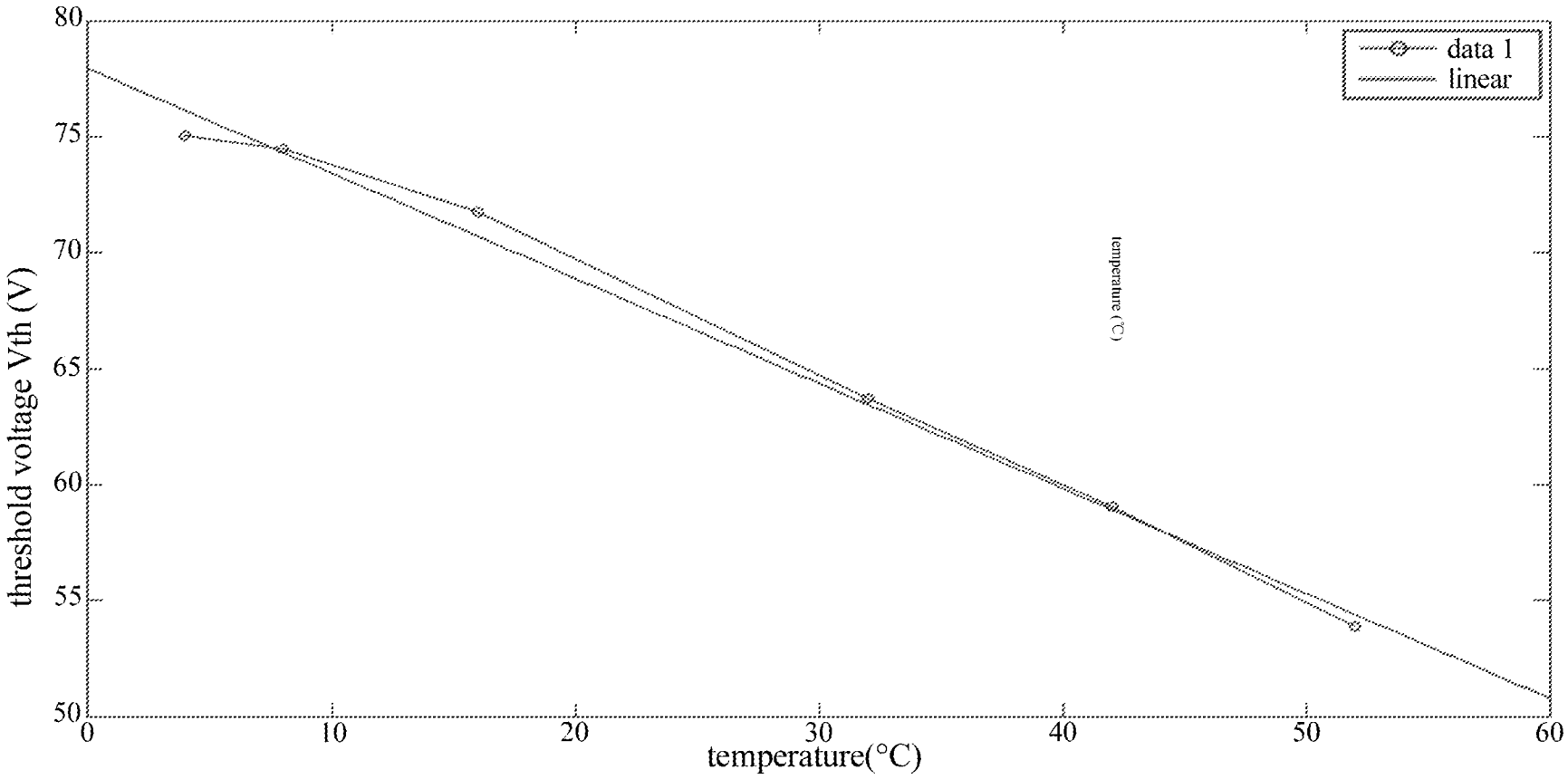
FIG. 4 is a variation curve of a threshold voltage versus temperature according to an embodiment of the present disclosure.
Figure 5:
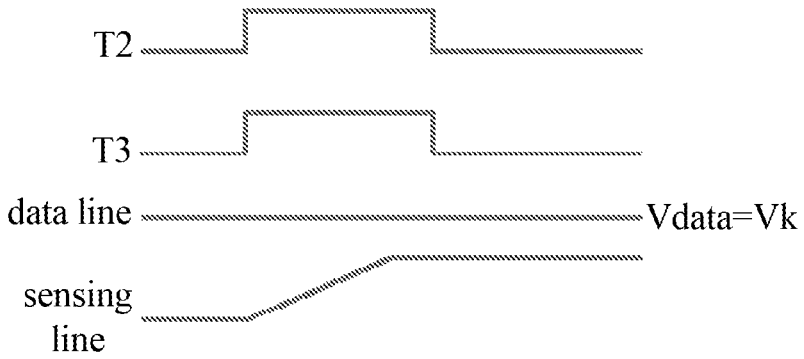
FIG. 5 is a waveform diagram of a detection of a second sensing voltage according to an embodiment of the present disclosure.

The method to generate the variation curve of ΔVth versus temperature may specifically be: in response to turning off the display panel, acquiring a second sensing voltage Vsense-2 at different temperatures in response to the data voltage Vdata being equal to a second set data voltage Vk; calculating a difference between the second set data voltage Vk and the second sensing voltage Vsense-2 to obtain the threshold voltage Vth; generating a variation curve of the threshold voltage Vth versus temperature based on the threshold voltage Vth at different temperatures; and generating the variation curve of the variation ΔVth of the threshold voltage versus temperature based on the variation curve of the threshold voltage Vth versus temperature. In detail, the second set data voltage Vk may be preset. When the display panel is off, the second sensing voltage Vsense-2 at different temperatures in response to Vdata=Vk is obtained. Consequently, Vth at different temperatures may be expressed as Vth=Vk−Vsense-2. According to the threshold voltage Vth at different temperatures, a variation curve of the threshold voltage Vth versus temperature as illustrated in FIG. 4 is generated, and then a variation curve of the variation ΔVth of the threshold voltage versus temperature is generated based on the generated variation curve of the threshold voltage Vth versus temperature. Vsense-2 at different temperatures in response to Vdata=Vk may be acquired by waveform detection as illustrated in FIG. 5.

As a possible implementation, the acquisition method of ΔK' may specifically be: acquiring a variation ΔK of a compensation coefficient corresponding to the current first sensing voltage Vsense-1-0 based on the current first sensing voltage Vsense-1-0 and a pre-stored correspondence relation curve between the first sensing voltage Vsense-1 and the variation ΔK' of the compensation coefficient; and determining the variation ΔK of the compensation coefficient corresponding to the current first sensing voltage Vsense-1 as the variation ΔK' of the current compensation coefficient. In detail, the correspondence relation curve between the first sensing voltage Vsense-1 and the variation ΔK of the compensation coefficient is generated based on a variation curve of the variation ΔK of the compensation coefficient versus temperature and the variation curve of the first sensing voltage Vsense-1 versus temperature, and then the generated correspondence relation curve is stored. When Vsense-1-0 is acquired, the correspondence relation curve is queried to acquire ΔK corresponding to Vsense-1-0, and then the ΔK is determined as ΔK'.

Figure 6:
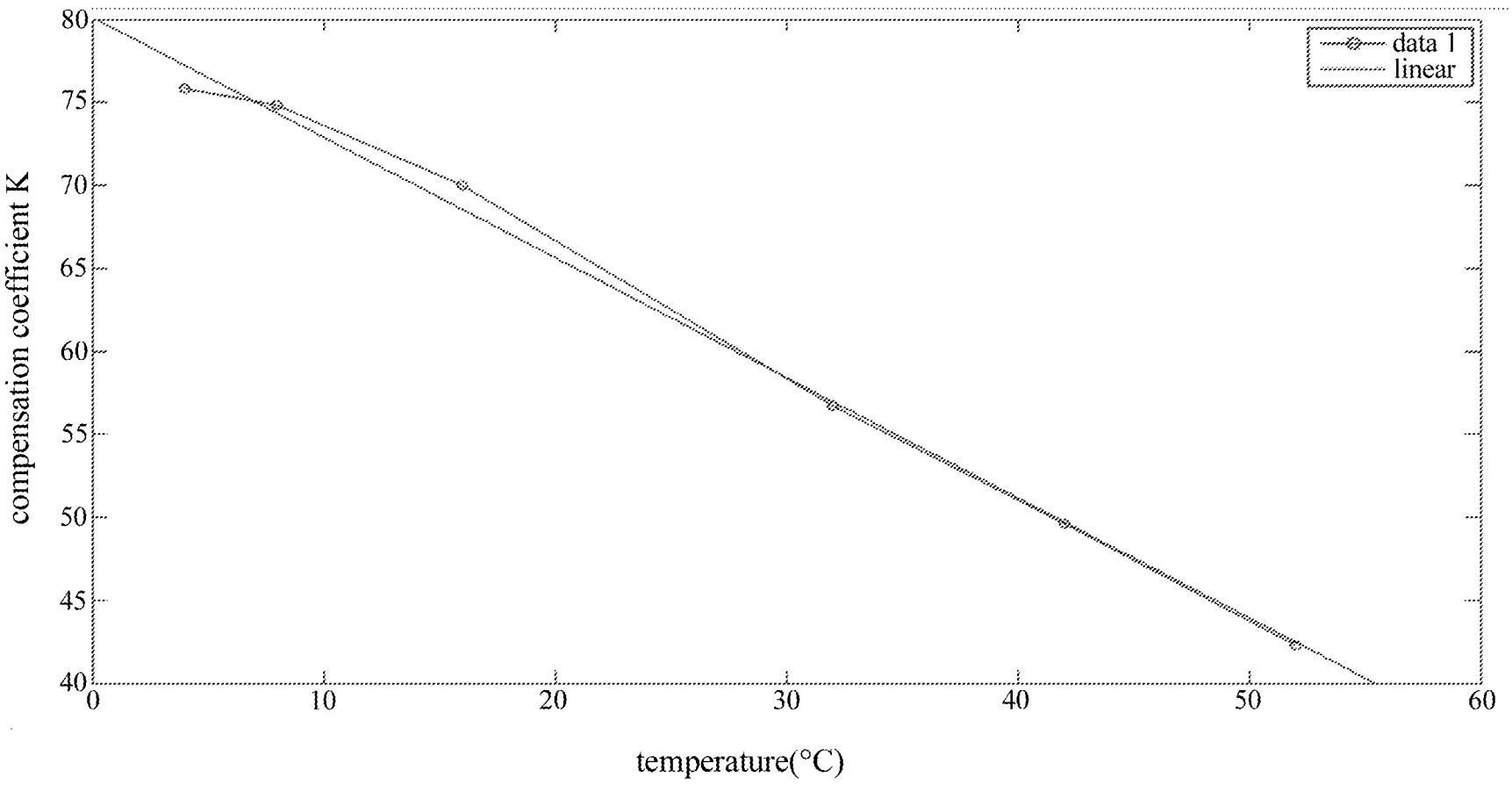
FIG. 6 is a variation curve of a compensation coefficient versus temperature according to an embodiment of the present disclosure.
Figure 7:
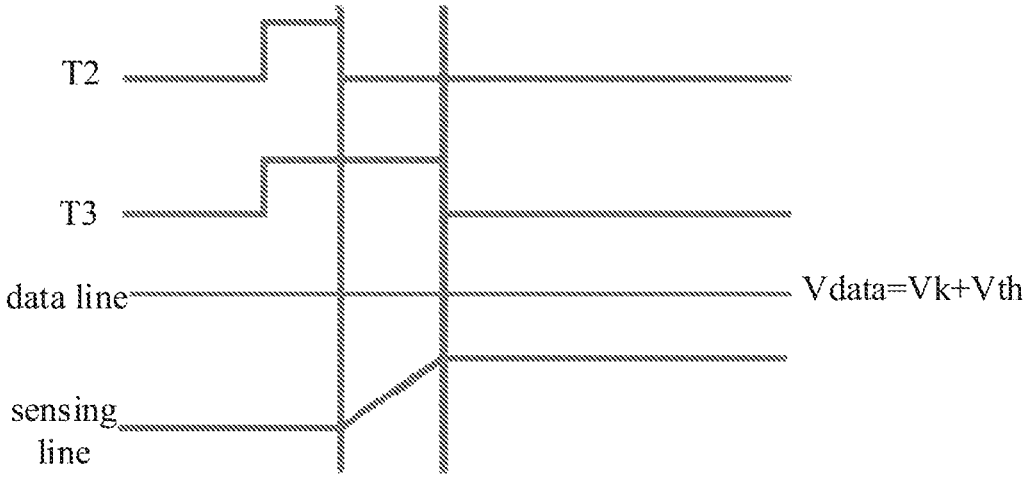
FIG. 7 is a waveform diagram of a detection of a third sensing voltage according to an embodiment of the present disclosure.

The method to generate the variation curve of ΔK versus temperature may specifically be: in response to turning off the display panel, acquiring a third sensing voltage Vsense-3 at different temperatures in response to the data voltage Vdata being equal to a third set data voltage Vk+Vth, in which the third set data voltage Vk+Vth is equal to a sum of the second set voltage Vk and the threshold voltage Vth at a corresponding temperature; calculating a ratio of a preset sensing voltage threshold V to the third sensing voltage Vsense-3 to obtain the compensation coefficient K; generating a variation curve of the compensation coefficient K versus temperature based on the compensation coefficient K at different temperatures; and generating the variation curve of the variation ΔK of the compensation coefficient versus temperature based on the variation curve of the compensation coefficient K versus temperature. In detail, the third set data voltage Vk+Vth and the sensing voltage threshold V may be preset. The third set data voltage Vk+Vth is equal to the sum of the second set voltage Vk and the threshold voltage Vth at the corresponding temperature. The sensing voltage threshold V is determined based on the display panel. The value range of the sensing voltage threshold V is generally the same as the value range of Vsense-3. If the display panel requires high brightness, the V may be set to a great value; and if the display panel requires low brightness, the V may be set to a small value. When the display panel is turned off, the third sensing voltage Vsense-3 at different temperatures in response to Vdata=Vk+Vth may be acquired, and thus K at different temperatures may be expressed as K=V/Vsense-3. The variation curve of the compensation coefficient K versus temperature as illustrated in FIG. 6 may be generated based on the compensation coefficient K at different temperatures. The variation curve of the variation ΔK of the compensation coefficient versus temperature may be generated based on the generated variation curve of the compensation coefficient K versus temperature. Vsense-3 at different temperatures in response to Vdata=Vk+Vth may be acquired by waveform detection as illustrated in FIG. 7.

At block S202, the display data is compensated based on the variation ΔVth' of the current threshold voltage and the variation ΔK' of the current compensation coefficient.

In the embodiment of the present disclosure, the display data is compensated based on the variation ΔVth' of the current threshold voltage and the variation ΔK' of the current compensation coefficient.

As a possible implementation, the display data is compensated through a preset formula. The preset formula is denoted by: data1=ΔK'*K0*data+ΔVth'+Vth0, where data1 represents the display data after compensation; ΔK' represents the variation of the current compensation coefficient; K0 represents an initial value of a compensation coefficient of the display panel at normal temperature; data represents the display data before compensation; ΔVth' represents the variation of the current threshold voltage; and Vth0 represents an initial value of a threshold voltage of the display panel at normal temperature.

With the display control method according to the embodiment of the present disclosure, the current threshold voltage and the current compensation coefficient of the TFT corresponding to the current first sensing voltage are acquired based on the current first sensing voltage, and then the display data is compensated based on the current threshold voltage and the current compensation coefficient, which may accurately perform temperature compensation on the display data of the display panel to improve the display effect.

Figure 8:
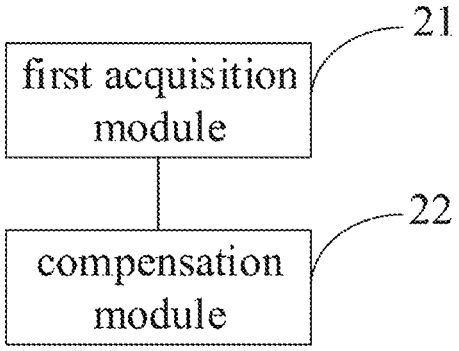
FIG. 8 is a schematic diagram of a display control apparatus according to an embodiment of the present disclosure.

FIG. 8 is a schematic diagram of a display control apparatus according to an embodiment of the present disclosure. As illustrated in FIG. 8, the display control apparatus includes a first acquisition module 21 and a compensation module 22.

The first acquisition module 21 is configured to, in response to turning on a display panel, acquire a current first sensing voltage when a data voltage is equal to a first set data voltage.

The compensation module is configured to compensate display data based on the current first sensing voltage.

It should be noted that the foregoing explanation of the embodiments of the display control method is also applicable to the display control apparatus according to the embodiment, and thus details will not be described here.

With the display control apparatus according to the embodiment of the present disclosure, in response to turning on the display panel, the current first sensing voltage is acquired when the data voltage is equal to the first set data voltage, and then the display data is compensated based on the current first sensing voltage, which may accurately compensate the display data of the display panel and improve the display effect.

Furthermore, in a possible implementation of the embodiment of the present disclosure, the compensation module 22 is specifically configured to: acquire, based on the current first sensing voltage, a variation of a current threshold voltage and a variation of a current compensation coefficient of a thin film transistor (TFT) corresponding to the current first sensing voltage; and compensate the display data based on the variation of the current threshold voltage and the variation of the current compensation coefficient.

Furthermore, in a possible implementation of the embodiment of the present disclosure, the compensation module 22 is specifically configured to compensate the display data through a preset formula. The preset formula is denoted by: $data1=\Delta K'*K0*data+\Delta Vth'+Vth0$, where data1 represents the display data after compensation, $\Delta K'$ represents the variation of the current compensation coefficient, K0 represents an initial value of a compensation coefficient of the display panel at normal temperature, data represents the display data before compensation, $\Delta Vth'$ represents the variation of the current threshold voltage, and Vth0 represents an initial value of a threshold voltage of the display panel at normal temperature.

Furthermore, in a possible implementation of the embodiment of the present disclosure, the compensation module 22 is specifically configured to: acquire a variation of a threshold voltage corresponding to the current first sensing voltage based on the current first sensing voltage and a pre-stored correspondence relation curve between a first sensing voltage and the variation of the threshold voltage; determine the variation of the threshold voltage corresponding to the current first sensing voltage as the variation of the current threshold voltage; acquire a variation of a compensation coefficient corresponding to the current first sensing voltage based on the current first sensing voltage and a pre-stored correspondence relation curve between the first sensing voltage and the variation of the compensation coefficient; and determine the variation of the compensation coefficient corresponding to the current first sensing voltage as the variation of the current compensation coefficient.

Furthermore, in a possible implementation of the embodiment of the present disclosure, the display control apparatus further includes a first generation module. The first generation module is configured to generate the correspondence relation curve between the first sensing voltage and the variation of the threshold voltage based on a variation curve of the variation of the threshold voltage versus temperature and a variation curve of the first sensing voltage versus temperature.

Furthermore, in a possible implementation of the embodiment of the present disclosure, the display control apparatus further includes: a second acquisition module, configured to, in response to turning off the display panel, acquire a second sensing voltage at different temperatures in response to the data voltage being equal to a second set data voltage; a first calculation module, configured to calculate a difference between the second set data voltage and the second sensing voltage to obtain the threshold voltage; and a second generation module, configured to generate a variation curve of the threshold voltage versus temperature based on the threshold voltage at different temperatures, and to generate the variation curve of the variation of the threshold voltage versus temperature based on the variation curve of the threshold voltage versus temperature.

Furthermore, in a possible implementation of the embodiment of the present disclosure, the display control apparatus further includes a third generation module. The third generation module is configured to generate the correspondence relation curve between the first sensing voltage and the variation of the compensation coefficient based on a variation curve of the variation of the compensation coefficient versus temperature and the variation curve of the first sensing voltage versus temperature.

Furthermore, in a possible implementation of the embodiment of the present disclosure, the display control apparatus further includes: a third acquisition module, configured to, in response to turning off the display panel, acquire a third sensing voltage at different temperatures in response to the data voltage being equal to a third set data voltage, in which the third set data voltage is equal to a sum of the second set voltage and the threshold voltage at a corresponding temperature; a second calculation module, configured to calculate a ratio of a preset sensing voltage threshold to the third sensing voltage to obtain the compensation coefficient; a fourth generation module, configured to generate a variation curve of the compensation coefficient versus temperature based on the compensation coefficient at different temperatures, and to generate the variation curve of the variation of the compensation coefficient versus temperature based on the variation curve of the compensation coefficient versus temperature.

It should be noted that the foregoing explanation of the embodiments of the display control method is also applicable to the display control apparatus according to the embodiment, and thus details will not be described here.

With the display control apparatus according to the embodiment of the present disclosure, in response to turning on the display panel, the current first sensing voltage is acquired when the data voltage is equal to the first set data voltage, and then the display data is compensated based on the current first sensing voltage, which may accurately compensate the display data of the display panel and improve the display effect.

Figure 9:
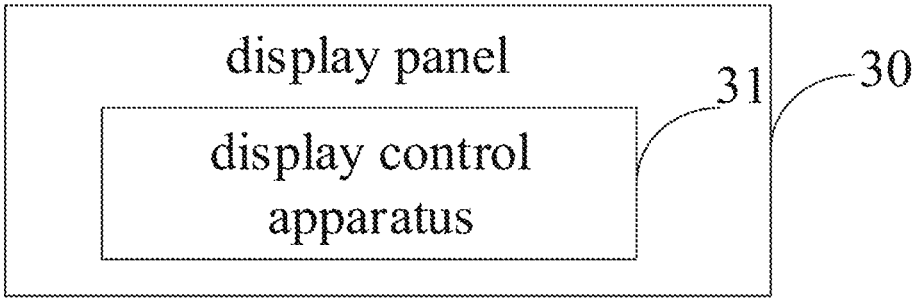
FIG. 9 is a schematic diagram of a display panel according to an embodiment of the present disclosure.

To implement the above embodiment, the embodiments of the present disclosure also provide a display panel 30. The display panel 30, as illustrated in FIG. 9, includes the display control apparatus 31 according to the above embodiment.

Furthermore, in a possible implementation of the embodiment of the present disclosure, the display panel is an OLED display panel, or an AMOLED display panel.

Figure 10:
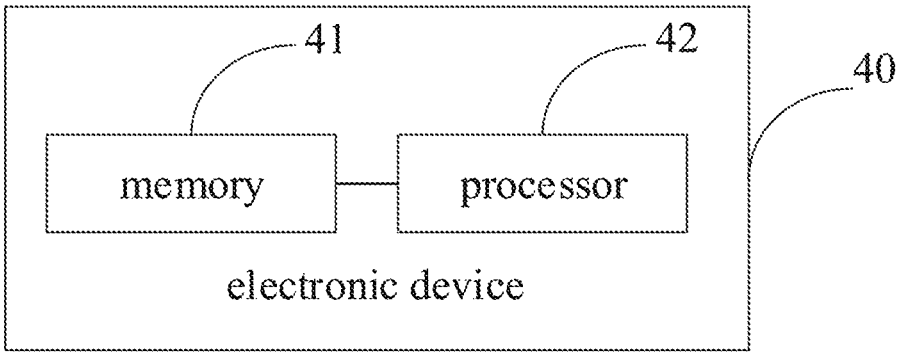
FIG. 10 is a schematic diagram of an electronic device according to an embodiment of the present disclosure.

To implement the above embodiments, the embodiments of the present disclosure also provide an electronic device 40. As illustrated in FIG. 10, the electronic device includes a memory 41 and a processor 42. The memory 41 stores a computer program that may be executable on the processor 42. When the processor 42 executes the program, the display control method according to the above embodiments is implemented.

To implement the above embodiments, the embodiments of the present disclosure also provide a non-transitory computer-readable storage medium having a computer program stored thereon. When the program is executed by a processor, the display control method according to the above embodiments is implemented.

Reference throughout this specification to "an embodiment," "some embodiments," "an example," "a specific example," or "some examples," means that a particular feature, structure, material, or characteristic described in connection with the embodiment or example is included in at least one embodiment or example of the present disclosure. The appearances of the above phrases in various places throughout this specification are not necessarily referring to the same embodiment or example of the present disclosure. Furthermore, the particular features, structures, materials, or characteristics may be combined in any suitable manner in one or more embodiments or examples. In addition, different embodiments or examples and features of different embodiments or examples described in the specification may be combined by those skilled in the art without mutual contradiction.

Although embodiments of present disclosure have been shown and described above, it should be understood that above embodiments are just explanatory, and cannot be construed to limit the present disclosure. For those skilled in the art, changes, alternatives, and modifications can be made to the embodiments without departing from spirit, principles and scope of the present disclosure.

What is claimed is:

1. A display control method, comprising:

in response to turning on a display panel, acquiring a current first sensing voltage when a data voltage is equal to a first set data voltage; and compensating display data based on the current first sensing voltage;

wherein the method further comprises:

in response to turning off the display panel, acquiring a second sensing voltage at different temperatures in response to the data voltage being equal to a second set data voltage;

calculating a difference between the second set data voltage and the second sensing voltage to obtain a threshold voltage corresponding to the current first sensing voltage;

generating a variation curve of the threshold voltage versus temperature based on the threshold voltage at different temperatures; and generating the variation curve of the variation of the threshold voltage versus temperature based on the variation curve of the threshold voltage versus temperature.

2. The display control method of claim 1, further comprising:

generating the correspondence relation curve between the first sensing voltage and the variation of the compensation coefficient based on a variation curve of the variation of the compensation coefficient versus temperature and the variation curve of the first sensing voltage versus temperature.

3. The display control method of claim 2, further comprising:

in response to turning off the display panel, acquiring a third sensing voltage at different temperatures in response to the data voltage being equal to a third set data voltage, the third set data voltage being equal to a sum of the second set voltage and the threshold voltage at a corresponding temperature;

calculating a ratio of a preset sensing voltage threshold to the third sensing voltage to obtain the compensation coefficient;

generating a variation curve of the compensation coefficient versus temperature based on the compensation coefficient at different temperatures; and generating the variation curve of the variation of the compensation coefficient versus temperature based on the variation curve of the compensation coefficient versus temperature.

4. The display control method of claim 1, wherein compensating the display data based on the current first sensing voltage comprises:

acquiring, based on the current first sensing voltage, a variation of a current threshold voltage and a variation of a current compensation coefficient of a thin film transistor (TFT) corresponding to the current first sensing voltage; and compensating the display data based on the variation of the current threshold voltage and the variation of the current compensation coefficient.

5. The display control method of claim 4, wherein compensating the display data based on the variation of the current threshold voltage and the variation of the current compensation coefficient comprises:

compensating the display data through a preset formula, the preset formula being denoted by:

$$data1=\Delta K'*K0*data+\Delta Vth'+Vth0,$$

where data1 represents the display data after compensation;

ΔK' represents the variation of the current compensation coefficient;

K0 represents an initial value of a compensation coefficient of the display panel at normal temperature;

data represents the display data before compensation;

ΔVth' represents the variation of the current threshold voltage; and

Vth0 represents an initial value of a threshold voltage of the display panel at normal temperature.

6. The display control method of claim 5, wherein acquiring, based on the current first sensing voltage, the variation of the current threshold voltage and the variation of the current compensation coefficient of the thin film transistor (TFT) corresponding to the current first sensing voltage comprises:

acquiring a variation of the threshold voltage based on the current first sensing voltage and a pre-stored correspondence relation curve between a first sensing voltage and the variation of the threshold voltage;

determining the variation of the threshold voltage corresponding to the current first sensing voltage as the variation of the current threshold voltage;

acquiring a variation of a compensation coefficient corresponding to the current first sensing voltage based on the current first sensing voltage and a pre-stored correspondence relation curve between the first sensing voltage and the variation of the compensation coefficient; and determining the variation of the compensation coefficient corresponding to the current first sensing voltage as the variation of the current compensation coefficient.

7. The display control method of claim 6, further comprising:

generating the correspondence relation curve between the first sensing voltage and the variation of the threshold voltage based on a variation curve of the variation of the threshold voltage versus temperature and a variation curve of the first sensing voltage versus temperature.

8. A display control apparatus, comprising:

a first acquisition module, configured to, in response to turning on a display panel, acquire a current first sensing voltage when a data voltage is equal to a first set data voltage;

a compensation module, configured to compensate display data based on the current first sensing voltage; and a second acquisition module, configured to, in response to turning off the display panel, acquire a second sensing voltage at different temperatures in response to the data voltage being equal to a second set data voltage;

a first calculation module, configured to calculate a difference between the second set data voltage and the second sensing voltage to obtain a threshold voltage corresponding to the current first sensing voltage; and a second generation module, configured to generate a variation curve of the threshold voltage versus temperature based on the threshold voltage at different temperatures, and to generate the variation curve of the variation of the threshold voltage versus temperature based on the variation curve of the threshold voltage versus temperature.

9. The display control apparatus of claim 8, further comprising:

a third generation module, configured to generate the correspondence relation curve between the first sensing voltage and the variation of the compensation coefficient based on a variation curve of the variation of the compensation coefficient versus temperature and the variation curve of the first sensing voltage versus temperature.

10. The display control apparatus of claim 9, further comprising:

a third acquisition module, configured to, in response to turning off the display panel, acquire a third sensing voltage at different temperatures in response to the data voltage being equal to a third set data voltage, the third set data voltage being equal to a sum of the second set voltage and the threshold voltage at a corresponding temperature;

a second calculation module, configured to calculate a ratio of a preset sensing voltage threshold to the third sensing voltage to obtain the compensation coefficient;

a fourth generation module, configured to generate a variation curve of the compensation coefficient versus temperature based on the compensation coefficient at different temperatures, and to generate the variation curve of the variation of the compensation coefficient versus temperature based on the variation curve of the compensation coefficient versus temperature.

11. A display panel, comprising: the display control apparatus of claim 8.

12. The display panel of claim 11, wherein the display panel is an OLED display panel, or an AMOLED display panel.

13. The display control apparatus of claim 8, wherein the compensation module is configured to:

acquire, based on the current first sensing voltage, a variation of a current threshold voltage and a variation of a current compensation coefficient of a thin film transistor (TFT) corresponding to the current first sensing voltage; and compensate the display data based on the variation of the current threshold voltage and the variation of the current compensation coefficient.

14. The display control apparatus of claim 13, wherein the compensation module is configured to:

compensate the display data through a preset formula, the preset formula being denoted by:

$$data1=\Delta K'*K0*data+\Delta Vth'+Vth0,$$

where data1 represents the display data after compensation;

ΔK' represents the variation of the current compensation coefficient;

K0 represents an initial value of a compensation coefficient of the display panel at normal temperature;

data represents the display data before compensation;

ΔVth' represents the variation of the current threshold voltage; and

Vth0 represents an initial value of a threshold voltage of the display panel at normal temperature.

15. The display control apparatus of claim 14, wherein the compensation module is configured to:

acquire a variation of the threshold voltage based on the current first sensing voltage and a pre-stored correspondence relation curve between a first sensing voltage and the variation of the threshold voltage;

determine the variation of the threshold voltage corresponding to the current first sensing voltage as the variation of the current threshold voltage;

acquire a variation of a compensation coefficient corresponding to the current first sensing voltage based on the current first sensing voltage and a pre-stored correspondence relation curve between the first sensing voltage and the variation of the compensation coefficient; and determine the variation of the compensation coefficient corresponding to the current first sensing voltage as the variation of the current compensation coefficient.

16. The display control apparatus of claim 15, further comprising:

a first generation module, configured to generate the correspondence relation curve between the first sensing voltage and the variation of the threshold voltage based on a variation curve of the variation of the threshold voltage versus temperature and a variation curve of the first sensing voltage versus temperature.

17. An electronic device, comprising: a storage device, a processor, and a computer program stored on the storage device and executable on the processor, wherein when the processor executes the program, the display control method of claim 3 is implemented.

18. A non-transitory computer-readable storage medium having a computer program stored thereon, wherein when the program is executed by a processor, the display control method of claim 3 is implemented.

* * * * *